US010236592B2

(12) United States Patent
Gok et al.

(10) Patent No.: US 10,236,592 B2
(45) Date of Patent: Mar. 19, 2019

(54) WIDE BAND ANTENNA ARRAY PLATFORM THAT CAN FIND DIRECTION ON AZIMUTH AND ELEVATION ANGLES

(71) Applicant: ASELSAN ELEKTRONIK SANAYI VE TICARET ANONIM SIRKETI, Ankara (TR)

(72) Inventors: Gokhan Gok, Ankara (TR); Ali Gunay Yildiz, Ankara (TR); Nihan Oznazli, Ankara (TR); Aykut Baris Inci, Ankara (TR)

(73) Assignee: ASELSAN ELEKTRONIK SANAYI VE TICARET ANONIM SIRKETI, Ankara (TR)

( * ) Notice: Subject to any disclaimer, the term of this patent is extended or adjusted under 35 U.S.C. 154(b) by 0 days.

(21) Appl. No.: 15/551,901

(22) PCT Filed: Jan. 4, 2016

(86) PCT No.: PCT/TR2016/050002

§ 371 (c)(1),
(2) Date: Aug. 17, 2017

(87) PCT Pub. No.: WO2016/133478

PCT Pub. Date: Aug. 25, 2016

(65) Prior Publication Data

US 2018/0034163 A1 Feb. 1, 2018

(30) Foreign Application Priority Data

Feb. 17, 2015 (TR) ..... a 2015/01912

(51) Int. Cl.
*H01Q 13/00* (2006.01)
*H01Q 21/06* (2006.01)
(Continued)

(52) U.S. Cl.
CPC ..... *H01Q 21/064* (2013.01); *H01Q 1/1264* (2013.01); *H01Q 3/06* (2013.01); *H01Q 13/00* (2013.01); *H01Q 21/00* (2013.01)

(58) Field of Classification Search
CPC ..... H01Q 1/084; H01Q 1/125; H01Q 3/06; H01Q 21/061
See application file for complete search history.

(56) References Cited

U.S. PATENT DOCUMENTS 3,940,771 A * 2/1976 Wild ..... H01Q 1/125 248/396
5,751,247 A * 5/1998 Nomoto ..... H01Q 3/02 342/359

(Continued)

FOREIGN PATENT DOCUMENTS

DE 4128972 A1 3/1993
JP S63174404 A 7/1988

(Continued)

*Primary Examiner* — Hoang V Nguyen
*Assistant Examiner* — Awat M Salih
(74) *Attorney, Agent, or Firm* — Gokalp Bayramoglu

(57) ABSTRACT

The present invention relates to an antenna array platform comprising at least one bottom plate, at least one magnet preferably located on the bottom side of the bottom plate, which provides the bottom plate to be attached to suitable platforms made of a material that can be attracted by magnetic field force without the need for any mechanical adaptations, at least one box located on the bottom plate, at least one lid covering the upper part of the box, a number of antenna slots equal to the number of antennas to be used, made in the lid, at least one plate that provides support so that the box stays at a required position, at least one screw positioned on at least one side of the plate and entering the angling hole that corresponds to the required angle, providing the plate stays fixed.

3 Claims, 3 Drawing Sheets

(51) Int. Cl.
*H01Q 1/12* (2006.01)
*H01Q 3/06* (2006.01)
*H01Q 21/00* (2006.01)

(56) References Cited

U.S. PATENT DOCUMENTS 5,977,924 A * 11/1999 Takei ..... H01Q 21/068 343/700 MS
6,243,046 B1 6/2001 Aoki
7,432,868 B2 * 10/2008 Webb ..... H01Q 1/08 343/766
2001/0046258 A1 * 11/2001 Wise ..... H01Q 1/084 375/219
2006/0119532 A1 * 6/2006 Yun ..... H01Q 1/362 343/895
2006/0168758 A1 * 8/2006 Chiang ..... H01Q 1/084 16/342
2009/0243955 A1 * 10/2009 Legare ..... H01Q 1/08 343/882
2011/0140965 A1 * 6/2011 Manasson ..... H01Q 21/061 342/374
2012/0133569 A1 * 5/2012 Pivit ..... H01Q 1/246 343/844
2013/0002505 A1 * 1/2013 Teillet ..... H01Q 1/246 343/835
2013/0293420 A1 * 11/2013 Yehezkely ..... H01Q 21/061 342/372
2014/0306072 A1 * 10/2014 Yang ..... H01Q 3/08 248/124.1

FOREIGN PATENT DOCUMENTS

JP H07263939 A 10/1995
SE 004128972 * 3/1993
WO WO0189028 A2 11/2001

* cited by examiner

WIDE BAND ANTENNA ARRAY PLATFORM THAT CAN FIND DIRECTION ON AZIMUTH AND ELEVATION ANGLES

CROSS REFERENCE TO RELATED APPLICATION

This application is the national phase entry of International Application No. PCT/TR2016/050002, filed on Jan. 4, 2016, which is based upon and claims priority to Turkish Patent Application No. 2015/01912, filed on Feb. 17, 2015, the entire contents of which are incorporated herein by reference.

FIELD OF THE INVENTION

The present invention relates to a wide band antenna array platform that can find 2-D direction without ambiguities.

BACKGROUND OF THE INVENTION

In the present applications, the elements of the antenna are generally placed at intervals of half the wave length. In this kind of placements, as the elements of the antenna are close enough to each other, the ambiguity problem seen in the direction finding antenna arrays is not formed.

Direction finding function is realized by utilizing the signals at the output of the elements of the antenna which are placed in the space in order to find direction. Especially in wide band antenna arrays, placing the elements of the antenna at intervals of half wavelength is not possible due to the sizes of the elements of the antenna.

Additionally, the accuracy of estimating direction is directly proportional to the size of the antenna array. When the elements of the antenna are placed at intervals of half the wavelength, too many antennas need to be used for the size of the antenna array to have the required accuracy.

The United States patent document numbered U.S. Pat. No. 6,243,046 (B1) in the background of the invention discloses two antenna units located on a pedestal device. The antenna units which are used for providing communication with satellites are able to move laterally and vertically.

The Japanese patent document numbered JPS63174404 (A) in the background of the invention discloses a device to which the antenna is mounted. Antenna can easily be elevated via elevation angle adjusting part formed in a circular arc. Antenna is located over the elevation angle adjusting part. Mounting board is fixed on a building or a surface. The adjustment of azimuth can be performed by rotating the elevation angle adjusting member.

The Japanese patent document numbered JPH07263939 (A) in the background of the invention discloses an antenna equipment. An antenna main body part is fixed on a rotating part with a spacer between them. Spacer might be inclined at angles 5, 0 and −5 degrees.

The international patent document numbered WO2001089028 (A2) discloses A portable, self-contained satellite transceiver is employed for establishing a communications link between a connected appliance and a satellite including polarized transmit and receive antennas. The transceiver comprises a base unit, including a generally planer upper surface and a direction indicator to facilitate orientation of the base unit along a selected azimuth for communication with the satellite. A generally plate-like antenna support member is pivotally connected to one end of the base unit housing so that the antenna support member is pivotable between a first or transport position and a second position at a selected angle to establish elevational alignment with the satellite. An antenna housing contains polarized, transmit and receive antennas suitable for communicating with the satellite. The antenna housing is rotatable with respect to the antenna support member to a selected angle for aligning the polarization of the antennas with the polarization of the satellite antennas.

The United States patent document numbered US20060168758 (A1) discloses a hinge structure and particularly to a hinge structure for use on a directional antenna to enable a directional plate to swivel relative to a base dock. The hinge structure according to the invention includes a body, a cover and a pair of axles. The body has a magnetic element to enable the entire hinge structure to be attracted to a metal material, such as a metal partition

SUMMARY OF THE INVENTION

The object of the invention is to provide an antenna array platform which provides performing the direction of arrival estimation of the incoming signal in two dimensions by means of high accuracy on azimuth and elevation angles in a wide frequency band.

BRIEF DESCRIPTION OF THE DRAWINGS

An antenna array platform in order to fulfill the objects of the present invention is illustrated in the attached figures, where.

Figure 1:
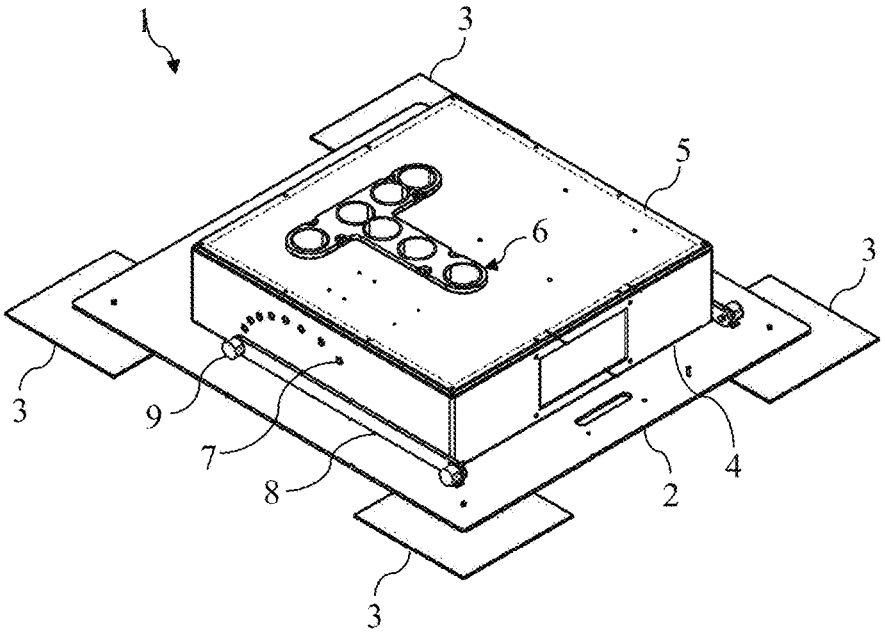
FIG. 1. Perspective view of inventive antenna array platform.
Figure 2:
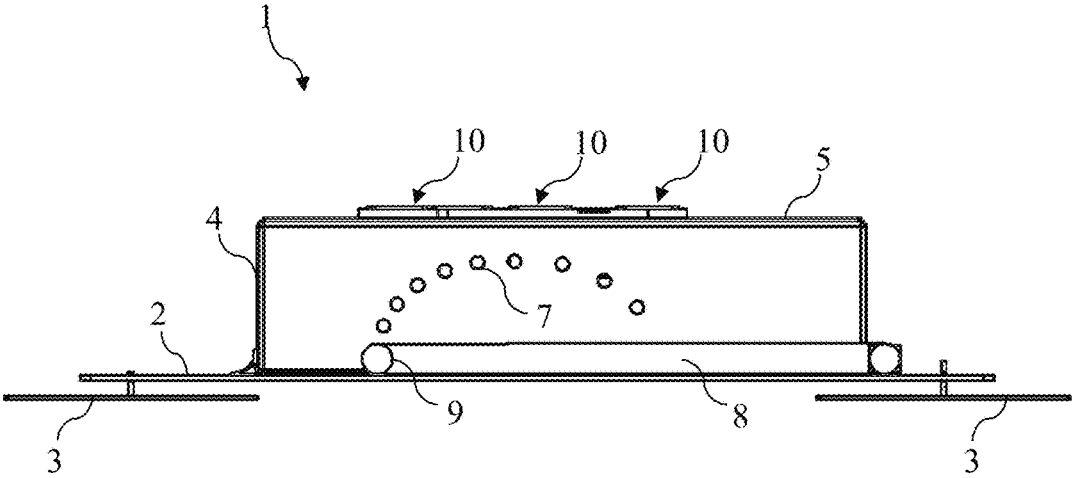
FIG. 2. Side view of inventive antenna array platform.
Figure 3:
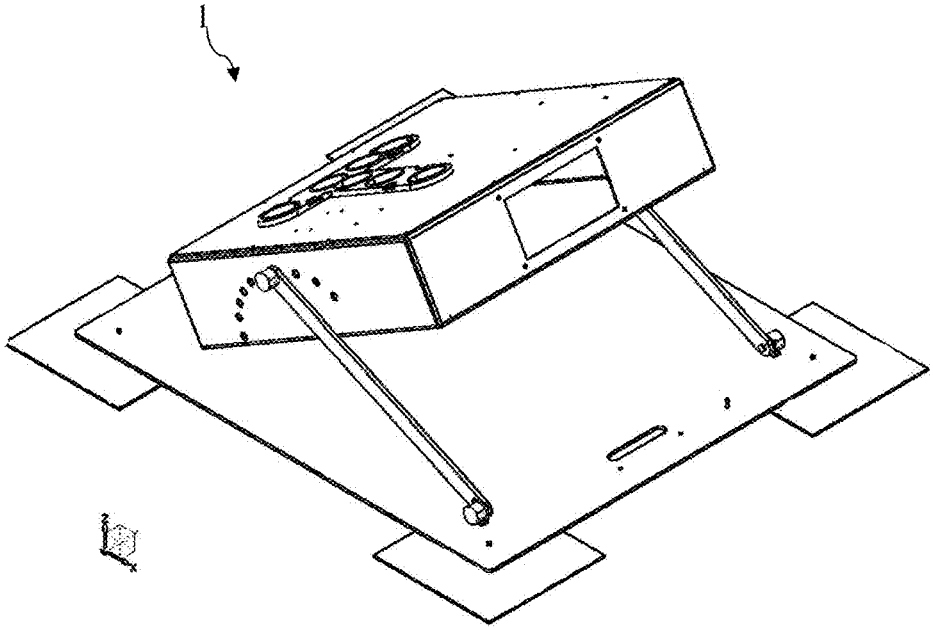
FIG. 3. Perspective view of inventive antenna array platform at 30 degrees to the ground.
Figure 4:
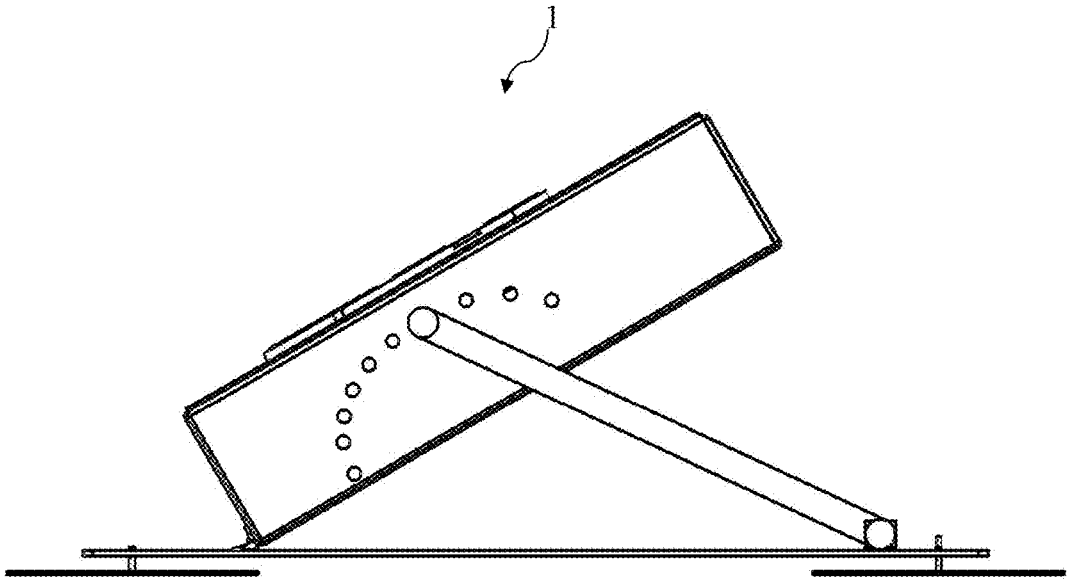
FIG. 4. Side view of inventive antenna array platform at 30 degrees to the ground.
Figure 5:
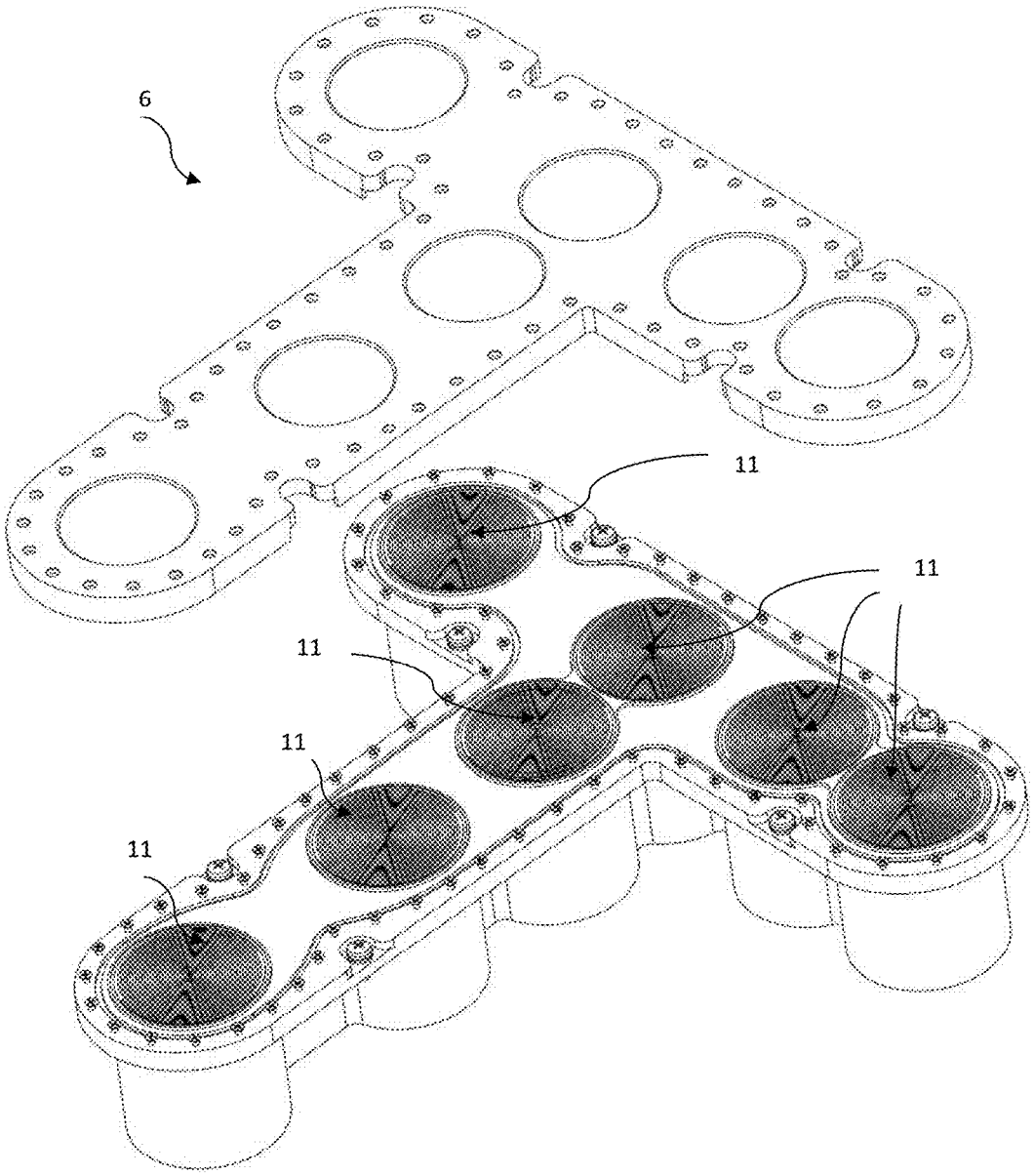
FIG. 5. Exploded top view of the hub showing the plurality of antennas forming antenna array to be used on the antenna array platform.

Elements shown in the figures are numbered as follows:

1. Antenna array platform
2. Bottom plate
3. Magnet
4. Box
5. Lid
6. Antenna hub
7. Angling hole
8. Plate
9. Screw
10. Antenna openings
11. Antenna

DETAILED DESCRIPTION OF THE INVENTION

An antenna array platform (1) which provides performing the estimation of the direction in a wide frequency band without ambiguity in azimuth and elevation angles, using an antenna array having different antenna distances which are longer than the half of the wavelength, essentially comprises:

at least one bottom plate (2), at least one magnet (3) preferably located on the bottom side of the bottom plate (2), which provides the bottom plate (2) to be attached to suitable platforms made of a material that can be attracted by magnetic field force without the need for any mechanical adaptations, at least one box (4) located on the bottom plate (2), at least one lid (5) covering the upper part of the box (4), a number of antenna openings (10) equal to the number of antennas (11) to be used, made in the lid (5)

angling holes (7) made in the side of the box (4) so that they correspond to certain angle values, at least one plate (8) that provides support so that the box (4) stays at a required position, at least one screw (9) entering the angling hole (7) positioned at at least one side of the plate (8) and that corresponds to the required angle, providing the plate (8) stays fixed Thanks to the inventive antenna array platform (1) the estimation of the direction in a wide frequency band without ambiguity in azimuth and elevation angles, using an antenna array having different antenna distances which are longer than the half of the wavelength, can be performed.

In the preferred embodiment of the invention, a bottom plate (2), a box (4) positioned on the bottom plate (2) and antenna openings (10) opened in the antenna hub (6) provided on the lid (5) closing the box (4) are present. In order to estimate the azimuth and elevation angles of the antenna array, taking into account the sizes of antenna elements to be used, accuracy of direction and ambiguity problem during the design phase, antennas are located on the antenna openings (10) at suitable positions so that an ambiguity on a plane is not formed.

Magnets (3) are preferably located on the bottom side of the bottom plate (2), in order for the antenna array platform (1) to be attached to suitable surfaces made of a material that can be attracted by magnetic field force. Thus, no mechanical adaptation processes needed on the platforms used.

An additional lifting mechanism is also used for the antenna array to be able to be positioned on azimuth and elevation angles. This lifting mechanism consists of angling holes (7) opened on the side of the box (4), a plate (8) and a screw (9). Angling holes (7) are present in the side of the box (4), between 0 degrees to 45 degrees with preferably 5 degree intervals, provided that the horizontal of the antenna is assumed 0 degrees. The antenna array can be positioned at a required angle value by means of preferably mace headed screw (9) positioned on at least one side of the plate (8) which is positioned on one side of the box (4), entering the angling holes (7) that corresponds to the required angle.

The invention claimed is:

1. An antenna array platform, comprising:

at least one bottom plate, at least one box located on the bottom plate, at least one lid covering an upper part of the box, angling holes made in a side of the box so that they correspond to certain angle values, at least one plate that provides support so that the box stays at a required position, at least one screw entering the angling hole positioned on at least one side of the plate and that corresponds to the required angle, providing the plate stays fixed, a plurality of antenna openings made in the lid, wherein the number of antenna openings are equal to the number of antennas to be used in the antenna array platform, wherein a distance between every two antenna openings is different, and a distance between two adjacent antenna openings is longer than half of a wavelength of the antennas;

wherein angling holes are provided in the side of the box between 0 degrees to 45 degrees with 5 degree intervals, provided that the horizontal of the antenna is assumed 0 degree.

2. The antenna array platform as in claim 1, wherein at least one magnet located on the bottom side of the bottom plate, wherein the at least one magnet provides the bottom plate to be attached to suitable platforms made of a material that can be attracted by magnetic field force without the need for any mechanical adaptations.

3. The antenna array platform as in claim 1, wherein a screw with a mace head is provided on one side of the plate.

* * * * *